US006174661B1

(12) United States Patent
Chen et al.

(10) Patent No.: US 6,174,661 B1
(45) Date of Patent: Jan. 16, 2001

(54) SILVER HALIDE PHOTOGRAPHIC ELEMENTS

(75) Inventors: Janglin Chen, Rochester; Yongcai Wang, Penfield; Gregory W. Keyes, Rochester; Richard A. Castle, Webster, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/221,776

(22) Filed: Dec. 28, 1998

(51) Int. Cl.[7] ..... G03C 1/89; G03C 1/76

(52) U.S. Cl. ..... 430/533; 430/523; 430/531; 430/536; 430/950; 430/961

(58) Field of Search ..... 430/523, 527–531, 430/533, 536, 950, 961

(56) References Cited

U.S. PATENT DOCUMENTS

| | | | |
|---|---|---|---|
| 3,121,060 | 2/1964 | Duane | 252/56 |
| 4,203,769 | 5/1980 | Guestaux | 430/523 |
| 4,612,279 | 9/1986 | Steklenski et al. | 430/536 |
| 4,735,976 | 4/1988 | Steklenski et al. | 524/32 |
| 4,766,059 | 8/1988 | Vandenabeele et al. | 430/523 |
| 5,204,233 | 4/1993 | Ogasawara et al. . | |
| 5,254,449 | 10/1993 | James et al. | 430/533 |
| 5,427,900 | 6/1995 | James et al. | 430/496 |
| 5,432,050 | 7/1995 | James et al. | 430/496 |
| 5,457,012 | 10/1995 | Nair et al. | 430/495 |
| 5,541,048 | 7/1996 | Whitesides et al. . | |
| 5,695,919 | 12/1997 | Wang et al. | 430/523 |
| 5,798,136 | 8/1998 | Landry-Coltrain et al. | 430/536 |

FOREIGN PATENT DOCUMENTS

| | | |
|---|---|---|
| 0080225 | 6/1983 | (EP) . |
| 0886176 | 12/1998 | (EP) . |
| 7181612 | 12/1995 | (JP) . |
| 7181613 | 12/1995 | (JP) . |

*Primary Examiner*—Richard L. Schilling
(74) *Attorney, Agent, or Firm*—Doreen M. Wells

(57) ABSTRACT

The present invention is a photographic element containing a support, at least one light sensitive emulsion layer superposed on the first side of the support, and an outermost lubricant layer superposed on the support. The outermost layer includes more than 80 percent by weight of a composite wax particle. The composite wax particle includes a wax phase and a non-crosslinked polymer phase. The wax phase is greater than 80 percent by weight of a wax which has a melting point of greater than 30° C. In one embodiment the lubricant layer contains a fluoro containing compound. It is envisioned that the lubricant layer overlies a transparent magnetic layer. The total coating weight of the composite wax particle in the lubricant layer is in the range of from 1 to 300 mg/m$^2$. Preferably, the fluoro compound contains at least one type of an ionic group or a nonionic group.

15 Claims, No Drawings

SILVER HALIDE PHOTOGRAPHIC ELEMENTS

CROSS REFERENCE TO RELATED APPLICATIONS

This application relates to commonly assigned copending application Ser. No. 09/221,639 now U.S. Pat. No. 6,048,674, filed simultaneously herewith. This application relates to commonly assigned copending application Ser. No. 09/221,469, pending filed simultaneously herewith. This application relates to commonly assigned copending application Ser. No. 09/221,083, now U.S. Pat. No. 6,075,090 simultaneously herewith. This application relates to commonly assigned copending application Ser. No. 09/221,470, pending filed simultaneously herewith. This application relates to commonly assigned copending application Ser. No. 09/221,465, now U.S. Pat. No. 6,048,677 filed simultaneously herewith. This application relates to commonly assigned copending application Ser. No. 09/221,883, pending filed simultaneously herewith. This application relates to commonly assigned copending application Ser. No. 09/221,516, now U.S. Pat. No. 6,048,678 filed simultaneously herewith. These copending applications are incorporated by reference herein.

FIELD OF THE INVENTION

The present invention relates to a photographic element having a transparent magnetic recording layer. More particularly, the present invention relates to a photographic element having a transparent magnetic recording layer overlaid with an improved lubricant layer comprising a composite wax particle.

BACKGROUND OF THE INVENTION

Layers of photographic elements other than the image-forming layer are commonly referred to auxiliary layers. There are many different types of auxiliary layers such as, for example, subbing layers, backing layers, interlayers, overcoat layers, receiving layers, stripping layers, antistatic layers and the like. Photographic elements often employ auxiliary layers comprising glassy, hydrophobic polymers such as polyacrylates, polymethacrylates, polystyrenes, or cellulose esters, for example. One typical application for such an auxiliary layer is as a backing layer to provide resistance to abrasion, scratching, blocking, and ferrotyping. Such backing layers may be applied directly onto the support material, applied onto a priming or "subbing" layer, or applied as an overcoat for an underlying layer such as an antistatic layer or the like. For example, U.S. Pat. No. 4,203,769 describes a vanadium pentoxide-containing antistatic layer that is overcoated with a cellulosic layer applied from an organic solvent. U.S. Pat. Nos. 4,612,279 and 4,735,976 describe organic solvent-applied layers comprising a blend of cellulose nitrate and a copolymer containing acrylic acid or methacrylic acid that serve as overcoats for antistatic layers.

When the auxiliary layer serves as the outermost layer, as is the case for a backing layer, it is desirable for this layer to have a low coefficient of friction (COF) to provide proper conveyance properties and to protect the photographic element from mechanical damage during the manufacturing process or customer use. It is known to protect photographic elements against mechanical damage by coating them with a layer comprising a lubricant such as a silicone fluid as described in U.S. Pat. No. 3,489,567, and a wax esters of high fatty acids or high fatty alcohols in U.S. Pat. No. 3,121,060. However, problems are encountered in the use of these lubricants. For example, when silicone is used as a lubricant for a backing layer, it may move to the surface of the support where a photographic element is to be coated. This will give an adverse effect (e.g. wetting) on the subsequent coating processes. They may also not survive processing so that the advantage of low surface friction is lost for the post-processed products. In addition, it has proven difficult to provide a single layer applied from organic medium that comprises both an abrasion-resistant polymer and a lubricant since it is difficult to find a coating medium that dissolves both the polymer and the lubricant and is at the same time attractive from an environmental and health standpoint. It is also difficult to form a stable dispersion of a lubricant such as a wax in an organic medium that may be added to a coating composition containing a dissolved, abrasion-resistant polymer. Therefore, in order to form a layer which can be applied from liquid organic medium that is both abrasion-resistant and has a low coefficient of friction one often applies two separate layers; a first layer which is comprised of an abrasion-resistant polymer and then a second layer which is comprised of a lubricant such as a wax. The need to apply these two separate layers increases both manufacturing complexity and cost.

Recent patent literatures have disclosed technologies for a photographic element to have a transparent magnetic recording layer for information and data recording and reading purposes. For example, U.S. Pat. No. 5,254,449 discloses the preparation and use of a substantially transparent magnetic recording layer in a novel photographic element. U.S. Pat. Nos. 5,427,900 and 5,432,050 describe transparent magnetic recording layers for use in photographic elements wherein organic solvents are used for the preparation of a dispersion containing the magnetic particles. U.S. Pat. No. 5,457,012 describes a magnetic recording layer formed from a dispersion of magnetic particles in an aqueous medium. The photographic element and particularly the transparent magnetic recording layer provided thereon must be capable of repeated use in both the recording and reading mode and, therefore, must be durable, abrasion resistant and scratch resistant so as not to adversely affect the quality of the photographic element. For example, during the residence of the film in a camera, entries may be made to the magnetic recording layer for every exposure, and an indeterminate number of read operations are conducted depending on the particular application to which the film is used. This also is true in the processing of the film and in subsequent use of the processed film for additional copies, enlargements and the like.

When a transparent magnetic recording layer is used as the outermost backing layer, excellent lubrication at its surface is required to lower the contact friction with the magnetic head and to allow for multiple transports of the film through various magnetic head-containing equipment. A lubricant could be added directly to the transparent magnetic layer. However, this typically weakens the layer and may result in premature rupture of the layer and loss of signal or recorded information. Furthermore, when the lubricant is added directly into the magnetic layer and coated and dried, the lubricant will be distributed throughout the magnetic layer and may not reside primarily at the surface where it is required for optimal performance. Alternatively, a separate lubricating layer is applied on the transparent magnetic recording layer. This of course reduces the manufacturing efficiency of the product by requiring several coating stations.

When a photographic element having a transparent magnetic recording layer as the backing layer is subjected to ordinary processing steps that differ from those related to ordinary magnetic tapes (e.g. audiotapes, and videotapes), new problem arises that staining materials, composed of ingredients in a developing solution, adhere to the back surface of the photographic element, and the said staining materials are transferred to the surface of a magnetic head at the time of the magnetic recording or reproduction after processing, which results in an error of magnetic input/output (an error in magnetic recording/reproducing). In order to solve such a problem, it is also effective to incorporate, into a backing layer, abrasives that are well known in the field of magnetic tape, for a silver halide photographic light-sensitive material having a transparent magnetic recording layer.

U.S. Pat. No. 5,798,136 describes a method of producing an imaging support which includes providing a support, simultaneously coating on a side of the support; a transparent magnetic recording layer comprising magnetic particles, a polymeric binder and an organic solvent, and a lubricating overcoat layer farthest from the support, the lubricating overcoat layer comprising wax particles having a size from 0.01 to 0.5 micron, and an organic solvent; and drying the magnetic recording layer and the lubricating overcoat layer. If the wax is dissolved in a solvent and coated simultaneously with the oxide layer, it can diffuse into the magnetic layer before the coating is dry. Thus, the amount of lubricant remaining at the surface is inadequate for proper lubrication. Since the diffusion rate is inversely proportional to the size of the dissolved lubricant, the wax dispersions, which are particles of sizes that are much larger than the radius of a dissolved long chain fatty acid or polymer, tend to remain at the surface during the coating process and provide adequate lubrication in the dried layer.

Aqueous wax dispersions of colloidal sizes (0.01 to 5 micron, typically in the range of from 0.01 to 1 micron) are generally known. Non-aqueous wax dispersions of colloidal sizes are difficult to prepare. Wax can be compounded into viscous non-aqueous media (viscosity greater than, for example, 1000 cps) by mechanical force. The problem with such an approach is that the particle size is difficult to predict and more difficult to reproduce. The resultant dispersions are not truly colloidal dispersions and on dilution wax particles will settle down or precipitate out. U.S. Pat. No. 5,798,136 has disclosed the preparation in acetone/methanol mixed solvents of polyethylene wax dispersions by first diluting the aqueous dispersions after dialysis. It has also disclosed the preparation of Carnauba wax dispersion in isobutyl alcohol by further ground using a ball mill of wax particle having an original size of greater than 2 microns.

U.S. Pat. No. 4,766,059 describes a method of making solid spherical beads having a mean size ranging form 0.5 to about 20 $\mu$m. The polymer beads contain a polymeric resinous material and a water insoluble wax. The process of making such solid beads involves the use of water miscible or immiscible low boiling solvent to dissolve both polymeric materials and wax, and subsequently removal of the solvent or solvent mixture by evaporation. This requires large processing equipment and lengthy processing time, which increases the expenses. U.S. Pat. No. 5,695,919 describes a lubricant impregnated core/shell polymer particle, the polymer particle comprising a core portion which is insoluble in the organic medium and a shell portion which has an affinity for both the core portion and the organic medium.

JP 7181613A describes a top layer on the side of the transparent magnetic recording layer that contains wax with an average grain size between 0.01 and 3 microns. However, the content of the wax in the layer is less than 50 weight percent of the binder. JP 7181612A claims an oxidized polyethylene wax (with an acid value of 5–55 and unsaturated terminals) on the transparent magnetic layer.

This invention provides the photographic element having a transparent magnetic layer with an improved lubricant layer that demonstrates excellent manufacturability, improved magnetic performance, improved running durability and scratch resistance, and improved resistance to stain materials during photographic processing.

SUMMARY OF THE INVENTION

The present invention is a photographic element containing a support, at least one light sensitive emulsion layer superposed on the first side of the support, and an outermost lubricant layer superposed on the support. The outermost layer includes more than 80 percent by weight of a composite wax particle. The composite wax particle includes a wax phase and a non-crosslinked polymer phase. The wax phase is greater than 80 percent by weight of a wax which has a melting point of greater than 30° C. In one embodiment the lubricant layer contains a fluoro containing compound.

It is envisioned that the lubricant layer overlies a transparent magnetic layer.

The total coating weight of the composite wax particle in the lubricant layer is in the range of from 1 to 300 mg/m$^2$.

Preferably, the fluoro compound contains at least one type of an ionic group or a nonionic group.

DETAILED DESCRIPTION OF THE INVENTION

In accordance with the presence invention, the lubricant layer is formed from a nonaqueous coating composition and consists of more than 80% of a composite wax particle having a wax phase and a non-crosslinked polymer phase. The wax phase is composed of greater than 80% by weight of a wax having a melting point of greater than 30° C. The total coating weight in the said lubricant layer is in the range of from 1 to 300 mg/m$^2$ and preferably from 5 to 150 mg/m$^2$. In principle, the upper value of the composite wax particle is limited by both the physical appearances and friction values of the lubricant layer. For example, if the coverage is too high, a hazing looking surface will appear, which therefore can have an effect on the sensitometric properties of the imaging element. The lower limiting value is set by the requirement on the surface friction value of the lubricant layer, which is determined by both manufacturing processes and the magnetic performance of the photographic element.

The composite wax particles of the present invention have a wax phase composed of greater than 80% by weight of a wax having a melting point of greater than 30° C., a non-crosslinked polymer phase, and preferably a mean size smaller than 1 micron. Wax useful for the practice of the invention has been described, for example, in references such as "The Chemistry and Technology of Waxes", A. H. Warth, 2$^{nd}$ Ed., Reinhold Publishing Corporation, New York, N.Y. 1956, and "Plastics Additives and Modifiers Handbook", Chapter 54–59, J. Ederibaum (Ed.), Van Nostrand Reinhold, New York, N.Y. 1992. Suitable waxes include hydrocarbon and/or ester-containing waxes, e.g. animal waxes such as beewax, plant waxes such as carnauba wax, paraffin waxes, microcrystalline waxes, Fischer-Torpsch waxes, polyethylene waxes, polypropylene waxes, and a mixture thereof.

The composite wax particle of the present invention is preferably prepared by polymerizing a vinyl monomer or a monomer mixture in the presence of pre-formed aqueous wax particles. Pre-formed aqueous wax dispersion (or emulsion) is primarily composed of wax particles, dispersants/surfactants, and water. The dispersants can be nonionic, anionic, and cationic, and can be polymeric and are used at levels as high as 20% of the wax. Wax particles can be formed by various methods known in the art. For example, they can be prepared by pulverizing and classifying dry waxes or by spray drying of a solution containing waxes followed by redipsersing the resultant particles in water using a dispersant; They can be prepared by a suspension technique which consists of dissolving a wax in, for example, a water immiscible solvent, dispersing the solution as fine liquid droplets in aqueous solution, and removing the solvent by evaporation or other suitable techniques; They can be prepared by mechanically grinding a wax material in water to a desired particle size in the presence a dispersant, heating the wax particles dispersed in water to above their melting point, and cooling the melted particles in water to form a stable wax emulsion.

In the present invention, the pre-formed aqueous wax dispersions are formed by the so-called "atmospheric emulsification" and "pressure emulsification" techniques. Atmospheric process is used to prepare wax dispersions for waxes with melting points below the boiling point of water. The process typically consists of melting wax and surfactant together, and optionally a base is added to the melt. Hot water is then slowly added to the wax melt at vigorous agitation (water to wax). Wax emulsion can also be formed by adding molten wax/surfactant blend to boiling water at vigorous agitation. Pressure emulsification is generally needed for wax with m.p. greater than 100° C. It is similar to the process described above except at temperatures above the water boiling point. Vessels capable of withstanding high pressures are normally used.

Ethylenically unsaturated monomers which may be used to prepare the polymer phase of the composite wax particles of the present invention may include acrylic monomers, such as acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitriles and amides of the same acids such as acrylonitrile, methacrylonitrile, acrylamide and methacrylarnide. Other monomers which may be used, either alone or in admixture with these acrylic monomers, include vinyl acetate, poly(ethylene glycol) (meth)acrylates, N-vinyl-2-pyrrolidone, vinylimidazole vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl methylene malonates, isoprene, and butadiene. The polymerization reaction involved in the present invention is initiated and maintained with an initiating agent or catalyst, which is very similar to those used in conventional emulsion polymerization. Most useful catalysts for the practice of the present invention are azo, diazo, and peroxide compounds, for example, benzoyl peroxide, azobisisobytyronitrile and azobiscyanovaleric acid. The amount of the initiators employed follows generally the practice in conventional emulsion polymerization. In general, the amounts can vary within the range of about 0.2 to 3 or 4 weight percent or possibly higher by weight of the total monomers. It is generally recognized that higher level of initiator tends to result in lowered molecular weight for the ultimate polymers. If the polymerization is carried out in multiple stages, the amount of initiators in the beginning or initiating stage is adjusted to match the proportion of the monomer then present, and further initiators are fed during the delayed feed stage to correspond to the delayed feed of the monomers. Basically, in any case, the initiators are supplied as needed to maintain the reaction in smooth and easily controlled conditions. Surfactants that can be used in the present invention include, for example, a sulfate, a sulfonate, a cationic compound, an amphoteric compound, and a polymeric protective colloid. Specific examples are described in "McCUTCHEON'S Volume 1: Emulsifiers & Detergents, 1995, North American Edition". Chain transfer agents may also be used to control the properties of the polymer particles formed.

Generally speaking, the reaction conditions employed in the execution of the present method parallels those utilized in conventional emulsion polymerization as regards such variables as temperature, time, agitation, equipment, etc. The reaction temperature can be maintained at a constant value or can vary from 50 to 80 or 90° C. If the reaction temperature varies, the starting temperature is usually around 50 to 55° C., and as the reaction proceeds exothermically, the temperature rises.

The time of the reaction is difficult to predict since it will depend upon other variables, such as the amount of initiating agent introduced, the reaction temperature, etc. If the amount of monomer is small, the reaction may be finished within about an hour but with larger amounts, the reaction will usually continue for 3 to 4 hours. Post-heating stages after all monomer has been added can be sued to insure that the polymerization has gone to completion and no free monomer is present. The sequence of addition of the various ingredients is not critical and can be varied. Usually, aqueous medium is first added to the reactor, then aqueous wax dispersion, and monomer in that order, all being added while the medium is thoroughly agitated, followed by the initiators, but other sequences are possible.

In one of the preferred embodiments of the invention, the polymerization process in the presence of pre-formed aqueous wax particles is carried out sequentially (see, for example, Padget, J. C. in Journal of Coating Technology, Vol 66, No. 839, pages 89 to 105, 1994). In this process, the polymerization is conducted in a monomer-starved manner.

The copolymer contained in the composite wax particles of the invention is properly designed to have good "bonding" with the wax phase and good compatibility in the solvent medium. Defining compatibility of the copolymer in the solvent medium can be achieved by using the concept of "polymer solubility map" (see, for example, Ramsbothan, J. in Progress in Organic Coatings, Vol 8, pages 113–141, 1980; and Wicks, Jr. Z. W., Jones, F. N., and Papas, S. P. in Organic Coatings, pages 229–239, 1992, John Wiley & Sons, Inc.). As the organic solvents, any of the solvents customarily used in coating compositions may be satisfactorily used.

Since the polymer contained in the composite wax particle of the invention must be soluble in the non-aqueous medium it is necessary that the polymer is firmly bound either physically or chemically to the wax phase. Otherwise the polymer may be dissolved away from the wax phase and the composite wax particles would lose its stability. Chemical bonding can be achieved by grafting of the polymer to the wax phase. One of the mechanisms may involve abstraction of hydrogen from the wax molecule by free radical present in the system, giving active centers onto which the polymer chain may grow.

Although the polymer phase contains non-crosslinked polymers, the polymers may carry in addition to the polymerizable group a chemically functional group wherein the non-crosslinked polymers are rendered crosslinkable by an external crosslinking agent and can be crosslinked after the application to a substrate of a coating compostion into which the composite wax particles are incorporated.

The composite wax particles of the invention may be incorporated directly into a coating composition, the main film forming constituent of which is compatible with the composite wax particles. Alternatively, the composite wax particles may be first isolated from the aqueous dispersion, for example, by spray drying, and then be incorporated into a liquid coating composition as a dry powder. As a further alternative, the composite wax particles thus isolated may be blended into a powder coating composition.

Preferably the lubricant layer of the invention contains a fluoro compound. Most preferably, the fluoro compound is a fluoro surfactant including for example, nonionic fluorinated alkyl esters such as FC-430, FC-43 1, FC-10, FC-171, FC-99, FC-143, FC-170C sold by Minnesota Mining and Manufacturing Co., Zonyl fluorochemicals such as Zonyl-FSN, Zonyl-FTS, Zonyl-TBS, Zonyl-BA sold by DuPont; fluorinated surfactants sold by Elf Atochem under the tradename FORAFAC The lubricant layer of the invention may also contain other surfactants, dispersants, or coating aids including, but not limited to, polysiloxanes such as Dow Corning DC 1248, DC200, DC510, DC 190 and BYK 320, BYK 322, sold by BYK Chemie and SF 1079, SF1023, SF 1054, and SF 1080 sold by General Electric; Silwet surfactants sold by Union Carbide, polyoxyethylene-lauryl ether surfactants sold by Kodak; sorbitan laurate, palmnitate and stearates such as Span surfactants sold by Aldrich, Triton X surfactants sold by Union Carbide, amine-containing surfactants, Solsperse from ICI, and the like.

The support for the present invention can be cellulose ester, cellulose triacetate, cellulose diacetate, cellulose acetate propionate, polyesters, such as polyethylene terephthalate or polyethylene naphthalate, poly-1,4-cyclohexanedimethylene terephthalate, polybutylene terephthalate, and copolymers thereof, polyimides, polyamides, polycarbonates, polystyrene, polyolefins, such as polyethylene, polypropylene, polysulfones, polyarylates, polyether imides and blends of these. The support typically employs an undercoat or a subbing layer well known in the art that comprises, for example, for a polyester support a vinylidene chloride/methyl acrylate/itaconic acid terpolymer or a vinylidene chloride/acrylonitrile/acrylic acid terpolymer.

The photographic elements according to this invention can contain one or more conducting layers such as antistatic layers and/or antihalation layers such as described in Research Disclosure, Vol. 176, December 1978, Item 17643 to prevent undesirable static discharges during manufacture, exposure and processing of the photographic element. Antistatic layers conventionally used for color films have been found to be satisfactory herewith. Any of the antistatic agents set forth in U.S. Pat. No. 5,147,768 which is incorporated herein by reference may be employed. Preferred antistatic agents include metal oxides, for example tin oxide, antimony doped tin oxide and vanadium pentoxide. These anitstatic agents are preferably dispersed in a film forming binder.

As the organic solvent, any of the members customarily used in coating compositions may be satisfactorily used. However, the preferred solvents for the practice of the present invention may include, for example, acetone, methyl ethyl ketone, methanol, ethanol, butanol, dowanol PM, iso-propanol, propanol, toluene, xylene, methyl isobutyl ketone, methylene chloride, and their mixtures.

The magnetic particles in the transparent magnetic layer can be ferromagnetic iron oxides, such as $\gamma Fe_2O_3$, $Fe_3O_4$, $\gamma$-$Fe_2O_3$ or $Fe_3O_4$ with Co, Zn or other metals in solid solution or surface treated or ferromagnetic chromium dioxides, such as $CrO_2$ with metallic elements, for example Li, Na, Sn, Pb, Fe, Co, Ni, and Zn, or halogen atoms in solid solution. Ferromagnetic pigments with an oxide coating on their surface to improve their chemical stability or dispersability, as is commonly used in conventional magnetic recording, may also be used. In addition, magnetic oxides with a thicker layer of lower refractive index oxide or other material having a lower optical scattering cross-section as taught in U.S. Pat. Nos. 5,217,804 and 5,252,444 can be used. These are present in the transparent magnetic layer in the amount from about 1 to 10 weight percent based on the weight if the binder. The magnetic particles have a surface area greater than 30 $m^2/g$ preferably 40 $m^2/g$ and a coverage of from about 10 $mg/m^2$ to 100 $mg/m^2$. A dispersing agent, or wetting agent can be present to facilitate the dispersion of the magnetic particles. This helps to minimize the agglomeration of the magnetic particles. Useful dispersing agents include fatty acid amines and commercially available wetting agents such as Witco Emcol CC59 which is a quaternary amine available from Witco Chemical Corp. Rhodafac PE 510, Rhodafac RE 610, Rhodafac RE960, and Rhodafac L0529, which are phosphoric acid esters available from Rhone-Poulenc.

The polymer binder of the transparent magnetic layer may be any polymer having good abrasion resistance. For example, cellulose esters such as cellulose diacetates and triacetates, cellulose acetate propionate, cellulose acetate butyrate, cellulose nitrate, polyacrylates such as poly(methyl methacrylate), poly(phenyl methacrylate) and copolymers with acrylic or methacrylic acid, or sulfonates, polyesters, polyurethanes, urea resins, melamine resins, urea-formaldehyde resins, polyacetals, polybutyrals, polyvinyl alcohol, epoxies and epoxy acrylates, phenoxy resins, polycarbonates, vinyl chloride-vinyl acetate copolymers, vinyl chloride-vinyl acetate-vinyl-alcohol copolymers, vinyl chloride-vinyl acetate-maleic acid polymers, vinyl chloride-vinylidene chloride copolymers, vinyl chloride-acrylonitrile copolymers, acrylic ester-acrylonitrile copolymers, acrylic ester-vinylidene chloride copolymers, methacrylic ester-styrene copolymers, butadiene-acrylonitrile copolymers, acrylonitrile-butadiene-acrylic or methacrylic acid copolymers, styrene-butadiene copolymers can be used as binders in the transparent magnetic layer. Cellulose ester derivatives, such as cellulose diacetates and triacetates, cellulose acetate propionate, cellulose nitrate, and polyacrylates such as poly(methyl methacryl ate), poly(phenyl methacryl ate) and copolymers with acrylic or methacrylic acid are preferred.

Abrasive particles useful in the transparent magnetic layer include nonmagnetic inorganic powders with a Mohs scale hardness of not less than 6. These include, for example, metal oxides such as $\alpha$-alumina, chromium oxide $Cr_2O_3$, $\alpha$-$Fe_2O_3$, silicon dioxide, alumino-silicate and titanium dioxide. Carbides such as silicone carbide and titanium carbide, nitrides such as silicon nitride, titanium nitride and diamond in fine powder may also be used. A-alumina and silicon dioxide are preferred. These are included to improve the head cleaning properties and improve durability of the coating. A dispersing agent, or wetting agent can be present to facilitate the dispersion of the abrasive particles. This helps to minimize the agglomeration of the particles. Useful dispersing agents include, but are not limited to, fatty acid amines and commercially available wetting agents such as Solsperse 24000 sold by Zeneca, Inc. (ICI). The abrasive particles have a median diameter of about 0.2 to 0.4 $\mu$m. The abrasive particles are present in the transparent magnetic layer, the lubricant layer, or both. They are present in the magnetic layer in the amount of at least 2 weight percent based on the weight of the binder so that durability of the coating is achieved and clogging of the magnetic heads is prevented. The upper limit of the amount of abrasive particles is determined by the loss of transparency of the layer, adversely affecting the photographic element, and by their abrasive effects on the magnetic heads and the tools and photographic apparatus that the film comes in contact with, leading to premature wear of these tools and apparatus. Typically, the abrasive particles are present in the transparent magnetic layer in the amount of 2 wt % to about 20 wt % relative to the weight of the binder.

Filler particles useful in the transparent magnetic layer have a median diameter less than 0.15 $\mu$m, preferably less than 0.1 $\mu$m. The filler particles have a Mohs hardness greater than 6 and are present in the amount from about 0 to 300 percent, most preferably in the amount from about 0 to 85 percent based on the weight of the binder. Examples of filler particles include nonmagnetic inorganic powders such as $\gamma$-aluminum oxide, chromium oxide, iron oxide, tin oxide, doped tin oxide, silicon dioxide, alumino-silicate, titanium dioxide, silicon carbide, titanium carbide, and diamond in fine powder, as described in U.S. Pat. No. 5,432,050. A dispersing agent, or wetting agent can be present to facilitate the dispersion of the filler particles. This helps to minimize the agglomeration of the particles. Useful dispersing agents include, but are not limited to, fatty acid amines and commercially available wetting agents such as Solsperse 24000 sold by Zeneca, Inc. (ICI). Preferred filler particles are gamma-aluminum oxide and silicon dioxide.

The transparent magnetic layer may include coating aids and surfactants such as nonionic fluorinated alkyl esters such as FC-430, FC-43 1, FC-10, FC171 sold by Minnesota Mining and Manufacturing Co., Zonyl fluorochemicals such as Zonyl-FSN, Zonyl-FTS, Zonyl-TBS, Zonyl-BA sold by DuPont; fluorinated surfactants sold by Elf Atochem under the tradename FORAFAC; polysiloxanes such as Dow Corning DC 1248, DC200, DC510, DC 190 and BYK 320, BYK 322, sold by BYK Cherie and SF 1079, SF1023, SF 1054, and SF 1080 sold by General Electric; polyoxyethylene-lauryl ether surfactants sold by Eastman Chemical Co.; sorbitan laurate, palmitate and stearates such as Span surfactants sold by Aldrich.

Viscosity modifiers can be present in the lubricant layer or the transparent magnetic layer. Such viscosity modifiers include high molecular weight cellulose esters, celluosics, acrylics, urethanes, and polyethylene oxides.

The coating composition of the invention can be applied by any of a number of well-know techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in Research Disclosure No. 308119, Published Dec. 1989, pages 1007 to 1008. The caoting composition of the invetion is preferably applied by the method described in U.S. Pat. No. 5,798,136.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as poly(vinyl alcohol), polyacrylamide, poly(vinyl pyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the photographic elements of the present invention can contain one or more auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers that form magenta dye images are pyrazolones and pyrazolotriazoles. Preferred couplers that form yellow dye images are benzoylacetanilides and pivalylacetanilides.

The following examples are used to illustrate the present invention. However, it should be understood that the invention is not limited to these illustrative examples.

EXAMPLES

Preparation of the Composite Wax Particle useful for the practice of the Invention A stirred reactor containing 438.3 g of Michemlube 160 (a Carnauba wax dispersion at 25% solids, from Michelman, Inc.) was heated to 85° C. and purged with $N_2$ for 2 hour. 0.365 g of azobisisobutyronitrile in 10 g of toluene was then added to the reactor. An emulsion containing 109.6 g of deionized water, 32.9 g of 10% by weight Triton X100 surfactant, 9.1 g of a 10% by weight sodium dodecyl sulfonate surfactant, 87.7 g of methyl methacrylate, 21.9 g of vinyl pyrrolidone, and 0.18 g of azobisisobutyronitrile was added continuously for 2 hours. The reaction was allowed to continue for 4 more hours before the reactor was cooled down to room temperature. The composite wax particle dispersion prepared was filtered through glass fiber to remove any coagulum.

The resultant composite wax particle dispersion has a solid of about 31%. The particle contains about more than 40% by weight of Carnauba wax, about 50% by weight of poly(methyl methacrylate-co-vinyl pyrrolidone) (MMA/VP 80/20) with the balance being the amount of stabilizers/dispersants used. The composite wax particle is designated as Wax-21.

Composite wax particles Wax-2 to Wax 16 were prepared in a similar manner. Their compositions and other parameters are listed in Table 1.

TABLE 1

| Particle Designation | Wax Particle | Copolymer Composition | Wax/Polymer |
|---|---|---|---|
| Wax-1 | ML160 (130 nm) From Michelman, Inc. | Poly(methyl methacrylate-co-vinyl pyrrolidone) 80/20 | 50/50 |
| Wax-2 | ML160 (130 nm) From Michelman, Inc | Poly(methyl methacrylate-co-vinyl pyrrolidone) 60/40 | 50/50 |
| Wax-3 | ML160 (130 nm) From Michelman, Inc | Poly(methyl methacrylate-co-vinyl pyrrolidone) 90/10 | 50/50 |
| Wax-4 | ML160 (130 nm) From Michelman, Inc | Poly(methyl methacrylate-co-vinyl pyrrolidone) 95/5 | 50/50 |
| Wax-5 | ML160 (130 nm) From Michelman, Inc | Poly(methyl methacrylate-co-hydroxyethyl methacrylate) 97.5/12.5 | 50/50 |
| Wax-6 | ML160 (130 nm) From Michelman, Inc | Poly(methyl methacrylate-co-N,N-dimethyl acrylamide) 90/10 | 50/50 |
| Wax-7 | ML160 (130 nm) From Michelman, Inc | Poly(methyl methacrylate-co-2-vinylpyridine) 90/10 | 50/50 |
| Wax-8 | ML160 (130 nm) From Michelman, Inc | Poly(methyl methacrylate-co-poly(ethylene glycol) methacrylate Mn = 360) 95/15 | 50/50 |
| Wax-9 | ML160 (130 nm) From Michelman, Inc | Poly(methyl methacrylate-co-methacrylic acid) 85/15 | 50/50 |
| Wax-10 | ML160 (130 nm) From Michelman, Inc | Poly(ethyl methacrylate-co-methacrylic acid) 85/15 | 50/50 |
| Wax-11 | ML160 (130 nm) From Michelman, Inc | Poly(butyl methacrylate-co-methacrylic acid) 85/15 | 50/50 |
| Wax-12 | ME 48040 (300 nm) From Michelman, Inc | Poly(isobutyl methacrylate-co-methacrylic acid) 85/15 | 50/50 |
| Wax-13 | ME 48040 (300 nm) From Michelman, Inc | Poly(ethyl methacrylate-co-methacrylic acid) 85/15 | 50/50 |
| Wax-14 | ML160 (130 nm) From Michelman, Inc. | Poly(methyl methacrylate-co-vinyl pyrrolidone) 90/10 | 65/35 |
| Wax-15 | ML160 (130 nm) From Michelman, Inc. | Poly(methyl methacrylate) | 50/50 |
| Wax-16 | ML160 (130 nm) From Michelman, Inc | Poly(butyl methacrylate) | 50/50 |

EXAMPLE 1

This example shows that coating compositions comprising the composite wax particles of the invention provide transparent films with excellent frictional characteristics (i.e., low coefficient of friction values) even when incorporated at extremely low levels. Surface lubricant layer was prepared from coating composition consisting of Wax-1 to Wax-10, respectively, in an acetone/methanol solvent mixture. The coating compositions had excellent solution stability and gave transparent, dried surface lubricant layer when applied onto cellulose acetate substrate at a dry coverage of 50 mg/m$^2$. The coefficient of friction as measured by the method set forth in ANSI IT 9.4-1992 is about 0.1 or less.

A comparative surface layer was prepared by using Corn-1 on cellulose acetate support at a dry coverage of about 800 mg/m$^2$. Com-1 was prepared as described in U.S. Pat No. 5,695,919, and contained about 60% by weight core portion and 40% by weight shell portion and the wax content was 20% by weight of the polymer particles. The core portion polymer composition was 70% by weight isobutyl methacrylate and 30% by weight styrene. The shell portion polymer composition was 80% by weight isobutyl methacrylate and 20% by weight methacrylic acid. The coefficient of friction as measured by the method set forth in ANSI IT 9.4-1992 is about 0.15.

This example shows that the composite wax particles of this invention are superior to the lubricant impregnated polymer particles described in U.S. Pat No. 5,695,919, and capable of providing imaging elements with a coated layer with superior surface lubricity at extremely low dry coverage.

EXAMPLE 2

Coating Solution Stability

Coating solutions containing various types of wax dispersions were prepared at room temperature in various organic solvents and solvent mixtures. The coating solutions have a solids content varying from 0.5 to 0.8 percent by weight. The coating solution stability was inspected visually right after preparation, after storage at room temperature for 24 hours and after storage at room temperature for a week, respectively. Coating solutions in the Comparative solution samples were prepared as in U.S. Pat No. 5,798,136. The stability of the coating solutions prepared using wax particles disclosed in the prior art is very sensitive to the presence of coating addenda and to changes in solvent composition. The stability of the coating solutions prepared using the composite wax particles of the invention is excellent in many different solvent systems.

TABLE 2

Coating Solution Stability

| Coating Solution | Wax Particle | Solvent | Fluorinated Surfactant | Stability |
|---|---|---|---|---|
| Solution 1 (Comparative) | PE325N35* | Acetone/Methanol 50/50 | FC431 0.02 wt % | Immediate Flocculation |
| Solution 2 (Comparative) | ME39235** | Acetone/Methanol 50/50 | FC431 0.02 wt % | Immediate Flocculation |
| Solution 3 (Invention) | Wax-1 (Table 1) | Acetone/Methanol 50/50 | FC431 0.02 wt % | Stable |
| Solution 4 (Invention) | Wax-6 (Table 1) | Acetone/Methanol 50/50 | FC431 0.02 wt % | Stable |
| Solution 5 (Invention) | Wax-10 (Table 1) | Acetone/Methanol 50/50 | FC431 0.02 wt % | Stable |
| Solution 6 (Comparative) | PE325N35 | Isobutyl alcohol/ Dichloromethane 35/65 | No | Immediate Flocculation |
| Solution 7 (Comparative) | ME39235 | Isobutyl alcohol/ Dichloromethane 35/65 | No | Immediate Flocculation |
| Solution 8 (Invention) | Wax-1 (Table 1) | Isobutyl alcohol/ Dichloromethane 35/65 | No | Stable |
| Solution 9 (Invention) | Wax-6 (Table 1) | Isobutyl alcohol/ Dichloromethane 35/65 | No | Stable |
| Solution 10 (Invention) | Wax-10 (Table 1) | Isobutyl alcohol/ Dichloromethane 35/65 | No | Stable |
| Solution 11 (Invention) | Wax-1 (Table 1) | Isobutyl alcohol/ Dichloromethane 35/65 | FC431 0.02 wt % | Stable |
| Solution 12 (Invention) | Wax-6 (Table 1) | Isobutyl alcohol/ Dichloromethane 35/65 | FC431 0.02 wt % | Stable |
| Solution 13 (Invention) | Wax-10 (Table 1) | Isobutyl alcohol Dichloromethane 35/65 | FC431 0.02 wt % | Stable |
| Solution 14 (Invention) | Wax-15 (Table 1) | Toluene | No | Stable |
| Solution 15 (Invention) | Wax-15 (Table 1) | Toluene/Methanol 80/20 | FC431 0.02 wt % | Stable |
| Solution 16 (Invention) | Wax-16 (Table 1) | Toluene/Methanol 80/20 | FC431 0.02 wt % | Stable |
| Solution 17 (Invention) | Wax-16 (Table 1) | MEK | No | Stable |

*From Chemical Corporation of America
**From Michelman, Inc.

EXAMPLE 3

The transparent magnetic layer and lubricant layer were prepared by simultaneously coating solution A and solution B onto an annealed poly(ethylene naphthalate) support having an antistatic layer containing vanadium pentoxide. The magnetic oxide containing solution A, which is closer to the support, was generated by dispersing the magnetic particles (CSF-4085V2) and abrasive particles (E-600) in their respective solvents and respective stabilizing agents and adding these with a high shear mixer to a cellulose diacetate/cellulose triacetate solution in methylene chloride/acetone/methyl acetoacetate solvent mixture. A coating aid (optional), either FC-430 or FC-431, (3M Corporation) was added with low shear mixing. The composition of solution A is indicated in Table 3. The wax containing solution B, coated furthest from the support, was prepared in methylene chloride/isobutyl alcohol (65/35 weight ratio) using the composite wax particles in Table I and had a solid of about 0.8 percent by weight.

TABLE 3

Composition of Solution A

| Ingredient | Concentration (% by weight) |
|---|---|
| Cellulose diacetate [CA398-30] from Eastman Chemical Co. | 0.18 |
| Cellulose triacetate [CTA436-80S] from Eastman Chemical Co. | 2.45 |
| Rhodafac PE510 surfactant 0.006 | 0.12 |
| CSF-4085V2 from Toda Kogyo | |
| E-600 from Norton Chemical | 0.08 |
| Solsperse 24000 dispersant from Zeneca, Inc (ICI) | 0.004 |
| Dibutyl phthalate | 0.14 |
| Methylene chloride | 67.90 |
| Acetone | 24.25 |
| Methyl acetoacetate | 4.85 |

The solution A was metered to the bottom cavity and slot of a slot-die plus slide coating apparatus. The 1 solution B was prepared and metered to the top cavity and slot of the same slot-die plus slide coating apparatus. A coating apparatus of this type for multiple coatings is described in U.S. Pat. Nos. 2,761,417 and 2,761,791 (both 1956) by T. A. Russell et al. Slot heights are sized to achieve the required cavity pressures for widthwise uniformity. The slot-die plus slide was positioned at a spacing of 2–20 mils relative to the moving support, a vacuum was applied to the lower meniscus, and a liquid bead was established between the lips of the slot-die and the support such that a continuous coating was formed with the magnetic layer on the bottom and the wax layer on the top. The coated support was then conveyed through the dryers. The transparent magnetic layer prepared has a dry thickness of about 1.3 microns. The lubricant layer has a dry coverage of from 20 to 50 mg/m$^2$.

The coefficient of friction (COF) of the dried coating samples was measured using an IMASS Ball Sled friction tester. In the Ball Sled test, three tungsten balls were mounted in a triangular geometry onto a rigid support. The test sample was placed flat on another rigid support with the lubricated side of the sample facing upwards. The balls were then brought into contact with the test specimen and the sled was mechanically driven and set into horizontal motion, so that the test specimen and the balls were moving relative to each other. The force needed to sustain movement of the two surfaces relative to each other was measured and was related to the coefficient of friction (COF). The test results are listed in Table 4.

The durability of the coating was tested with a rotating drum friction tester (RDFT) where a narrow (½in) strip of the sample is placed in contact with a 4" diameter stainless steel drum utilizing a 180 degree wrap angle. One end of the sample was fixed and a 50 g load was placed on the other end of the sample. The lubricated side of the sample was in contact with the drum. The drum was rotated at 10.5"/sec and the friction between the drum and the sample were measured for a 10 minute time period. Desired results are a very flat and low friction vs. time curve for the duration of the test. The test was repeated on three different portions of the coating. Samples that "pass" will endure the entire test, maintaining a low friction. The test results are listed in Table 4.

The results in Table 4 clearly demonstrate that the samples prepared in accordance with the present invention exhibit excellent surface frictional characteristics and runnability compared to those prepared using wax particles disclosed in the prior art.

TABLE 4

| Coating Sample | Wax Particle mg/m$^2$ | Solvent | COF | RDFT |
|---|---|---|---|---|
| Sample 1 (Comparative) | ME02925 20 | Acetone/Methanol 50/50 | 0.20 | — |
| Sample 2 (Comparative) | ME02925 30 | Acetone/Methanol 50/50 | 0.20 | — |
| Sample 3 (Invention) | Wax-1 40 | DCM/IBA** 65/35 | 0.12 | Pass |
| Sample 4 (Invention) | Wax-3 40 | DCM/IBA 65/35 | 0.11 | — |
| Sample 5* (Invention) | Wax-1 40 | DCM\|\|BA 65/35 | 0.13 | Pass |
| Sample 6* (Invention) | Wax-1 30 | DCMIIBA 65/35 | 0.14 | Pass |
| Sample 7* (Invention) | Wax-1 50 | DCM/IBA 65/35 | 0.11 | Pass |
| Sample 8* (Invention) | Wax-3 40 | DCM/IBA 65/35 | 0.12 | Pass |
| Sample 9* (Invention) | Wax-4 40 | DCM/IBA 65/35 | 0.12 | Pass |
| Sample 10* (Invention) | Wax-5 40 | DCM/IBA 65/35 | 0.12 | Pass |
| Sample 11* (Invention) | Wax-15 40 | DCM/IBA 65/35 | 0.14 | Pass |
| Sample 12* (Invention) | Wax-14 40 | DCM/IBA 65/35 | 0.15 | Pass |

*Samples 5 to 12 were prepared with FC-431 added in the magnetic oxide layer.
**DCM: methlyene chloride, IBA: isobutyl alcohol The invention has been described in detail with particular reference to certain preferred embodiments thereof, but it will be understood that variations and modifications can be effected within the spirit and scope of the invention.

What is claimed is:

1. A photographic element comprising:

a support;

at least one light sensitive emulsion layer superposed on said support;

an outermost lubricant layer superposed on said support comprising more than 80 percent by weight of a composite max particle, the composite wax particle consisting essentially of a wax phase and a non-crosslinked polymer phase, the wax phase comprising greater than 80 percent by weight of a wax which has a melting point of greater than 30° C.

2. The photographic element of claim 1 wherein the outermost layer comprises a dry coating weight of from 1 to 300 mg/m$^2$.

3. The photographic element of claim 1 wherein the support comprises cellulose ester, cellulose triacetate, cellulose diacetate, cellulose acetate propionate, polyesters, polyimides, polyamides, polycarbonates, polystyrene, polyolefins, polysulfones, polyarylates or polyether imides.

4. The photographic element of claim 1 wherein the wax particle comprises a mean size smaller than 1 micron.

5. The photographic element of claim 1 wherein the wax phase of the wax particle further comprises dispersants/surfactants or water.

6. The photographic element of claim 1 wherein the wax comprises animal waxes, plant waxes, paraffin waxes, microcrystalline waxes, Fischer-Torpsch waxes, polyethylene waxes or polypropylene waxes.

7. The photographic element of claim 1 wherein the noncrosslinked polymer phase is free of chemically bonded acid groups and is prepared from monomers comprising acrylic monomers, hydroxyalkyl esters of acrylic monomers, nitrites of acrylic monomers, amides of acrylic monomers, vinyl acetate, poly(ethylene glycol)(meth) acrylates, N-vinyl-2-pyrrolidone, vinylimidazole vinyl propionate, vinylidene chloride, vinyl chloride, vinyl aromatic compounds, dialkyl maleates, dialkyl itaconates, dialkyl methylene malonates, isoprene or butadiene.

8. A photographic element comprising:

a support;

at least one light sensitive emulsion layer superposed on said support; and an outermost lubricant layer superposed on said support comprising a fluorocompound and more than 80 percent by weight of a composite wax particle, the composite wax particle comprising a wax phase and a non-crosslinked polymer phase, the wax phase comprising greater than 80 percent by weight of a wax which has a melting point of greater than 30° C.

9. The photographic element of claim 1 wherein the outermost lubricant layer further comprises surfactants or coating aids.

10. The photographic element of claim 1 further comprising one or more conducting layer superposed on the first or second side of said support.

11. A photographic element comprising:

a support having a first side and a second side;

at least one light sensitive emulsion layer superposed on the first side of said support;

a transparent magnetic layer comprising magnetic particles and a film forming binder; and an outermost lubricant layer overlying the transparent magnetic layer comprising more than 80 percent by weight of a composite wax particle, the composite wax particle consisting essentially of a wax phase and a non-crosslinked polymer phase, the wax phase comprising greater than 80 percent by weight of a wax which has a melting point of greater than 30° C.

12. The photographic element of claim 11 wherein the outermost layer comprises a dry coating weight of from 1 to 300 mg/m$^2$.

13. The photographic element of claim 11 wherein the magnetic particles comprise ferromagnetic iron oxides, surface treated or ferromagnetic chromium dioxides, or halogen atoms in solid solution.

14. The photographic element of claim 11 wherein the film forming binder comprises cellulose, polyacrylates, sulfonates, polyesters, polyurethanes, urea resins, melamine resins, urea-formaldehyde resins, polyacetals, polybutyrals, polyvinyl alcohol, epoxies, phenoxy resins, polycarbonates, vinyl chloride-vinyl acetate copolymers, vinyl chloride-vinyl acetate-vinyl-alcohol copolymers, vinyl chloride-vinyl acetate-maleic acid polymers, vinyl chloride-vinylidene chloride copolymers, vinyl chloride-acrylonitrile copolymers, acrylic ester-acrylonitrile copolymers, acrylic ester-vinylidene chloride copolymers, methacrylic ester-styrene copolymers, butadiene-acrylonitrile copolymers, acrylonitrile-butadiene-acrylic or methacrylic acid copolymers, or styrene-butadiene copolymers.

15. The photographic element of claim 11 wherein the transparent magnetic layer further comprises filler particles dispersing agents coating aids or surfactants.

* * * * *